US009899743B2

(12) United States Patent
Clayton et al.

(10) Patent No.: US 9,899,743 B2
(45) Date of Patent: Feb. 20, 2018

(54) FOLDABLE RADIO WAVE ANTENNA DEPLOYMENT APPARATUS FOR A SATELLITE

(71) Applicant: Cubic Corporation, San Diego, CA (US)

(72) Inventors: William R. Clayton, Huntsville, AL (US); Paul A. Gierow, Madison, AL (US)

(73) Assignee: Cubic Corporation, San Diego, CA (US)

( * ) Notice: Subject to any disclaimer, the term of this patent is extended or adjusted under 35 U.S.C. 154(b) by 155 days.

(21) Appl. No.: 14/883,392

(22) Filed: Oct. 14, 2015

(65) Prior Publication Data

US 2016/0036134 A1 Feb. 4, 2016

Related U.S. Application Data

(63) Continuation-in-part of application No. 14/334,374, filed on Jul. 17, 2014.

(51) Int. Cl.

| | |
|---|---|
| ***H01Q 15/16*** | (2006.01) |
| ***H01Q 1/28*** | (2006.01) |
| *H01Q 19/13* | (2006.01) |

(52) U.S. Cl.

CPC ..... *H01Q 15/161* (2013.01); *H01Q 1/288* (2013.01); *H01Q 19/132* (2013.01)

(58) Field of Classification Search

CPC ... H01Q 15/161; H01Q 19/132; H01Q 15/163
See application file for complete search history.

(56) References Cited

U.S. PATENT DOCUMENTS

| | | | | |
|---|---|---|---|---|
| 3,176,303 | A | 3/1965 | Holland | |
| 3,978,490 | A | 8/1976 | Fletcher et al. | |
| 4,168,504 | A | 9/1979 | Davis | |
| 4,490,726 | A | 12/1984 | Weir | |
| 4,527,166 | A | 7/1985 | Luly | |
| 4,672,389 | A | 6/1987 | Ulry | |
| 4,683,475 | A * | 7/1987 | Luly | H01Q 15/161 343/915 |
| 4,755,819 | A | 7/1988 | Bernasconi et al. | |
| 4,926,181 | A | 5/1990 | Stumm | |
| 5,255,006 | A * | 10/1993 | Pappas | H01Q 15/162 343/912 |
| 5,574,472 | A | 11/1996 | Robinson | |

(Continued)

FOREIGN PATENT DOCUMENTS

CN 101847786 A 9/2010

OTHER PUBLICATIONS

International Search Report and Written Opinion dated Oct. 5, 2015 for International Patent Application Np. PCT/US2015/040884 filed Jul. 17, 2015; all pages.

(Continued)

*Primary Examiner* — Graham Smith
*Assistant Examiner* — Noel Maldonado
(74) *Attorney, Agent, or Firm* — Kilpatrick Townsend and Stockton, LLP

(57) ABSTRACT

The present disclosure describes an antenna that has a parabola-shaped, flexible reflector member and one or more radial ribs embedded in the flexible reflector member and arranged to bias the reflector member in an open state.

16 Claims, 6 Drawing Sheets

(56) References Cited

U.S. PATENT DOCUMENTS

| | | | | |
|---|---|---|---|---|
| 5,597,631 | A * | 1/1997 | Furumoto | B29C 70/086 428/34.5 |
| 5,968,641 | A | 10/1999 | Lewis | |
| 6,340,956 | B1 | 1/2002 | Bowen et al. | |
| 6,373,449 | B1 | 4/2002 | Bokulic et al. | |
| 6,624,796 | B1 * | 9/2003 | Talley | H01Q 1/288 343/912 |
| 7,710,348 | B2 | 5/2010 | Taylor et al. | |
| 8,259,033 | B2 | 9/2012 | Taylor et al. | |
| 2006/0033674 | A1 | 2/2006 | Essig | |
| 2006/0270301 | A1 | 11/2006 | Marks | |
| 2011/0095956 | A1 | 4/2011 | Conrad | |
| 2013/0069849 | A1 | 3/2013 | Toledo | |

OTHER PUBLICATIONS

Non-final Office Action dated Nov. 29, 2016 for U.S. Appl. No. 14/334,374; all pages.

* cited by examiner

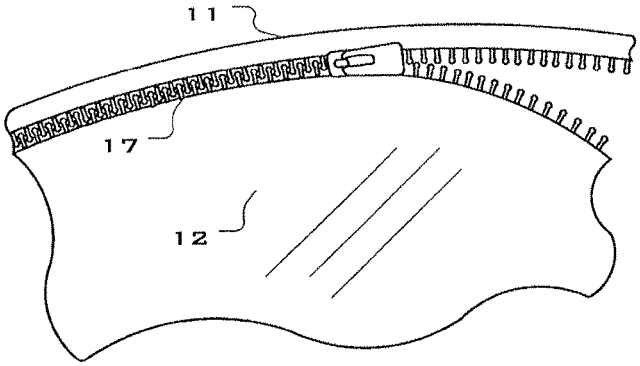
FIG. 5
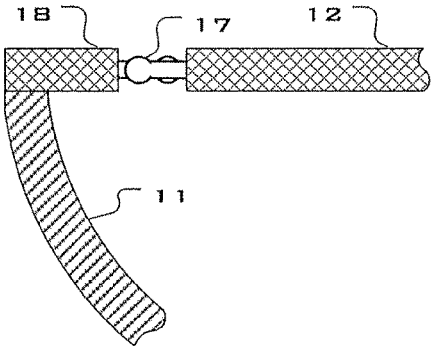
FIG. 6
FIG. 7A
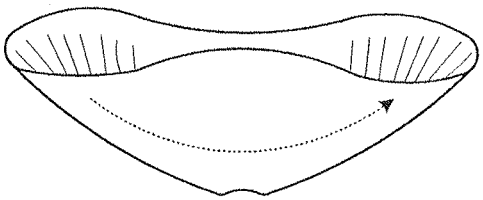
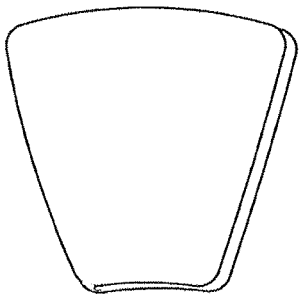
FIG. 7B

FOLDABLE RADIO WAVE ANTENNA DEPLOYMENT APPARATUS FOR A SATELLITE

CROSS-REFERENCE TO RELATED APPLICATIONS

This application is a continuation-in-part of, and claims priority to, co-owned and co-pending, U.S. application. Ser. No. 14/334,374, entitled, Foldable Radio Wave Antenna, filed Jul. 17, 2014, and which is incorporated by reference as if fully set forth herein.

BACKGROUND

Field

The present disclosure relates generally to a satellite having a radio wave antenna, and particularly to a deployment apparatus for a foldable radio wave antenna installed on such satellite.

Description of the Problem and Related Art

Transport of radio wave systems that use some form of electromagnetic reflecting antenna, i.e., radar or communications, is cumbersome, partially because of the antenna. Such antennas require an electromagnetically reflective substance, a metal, to operate, which has meant that the antenna is heavy and not easily stowed for transport. Collapsible metal antennas have often been used. Of course, these antennas are weighty and require complex actuator systems to be deployed.

Recently, antennas have been formed from lightweight materials such as composites, and polymers. These render the antenna light in weight compared to metal versions, but such antennas need other structures to maintain the shape of the reflector in a parabolic dish when the antenna is deployed in order not to degrade or inhibit the electromagnetic signal.

Often such antennas include rigid members to maintain the shape of the reflector, for example, a plurality of rigid ribs, as described in U.S. Pat. No. 3,978,490 to Talley, et al.; U.S. Pat. No. 7,710,348 to Taylor, et al.; and U.S. Pat. No. 8,259,033 to Taylor, et al. Other antennas employ other "rigidizing" means, such a rigid toroidal member incorporated in the periphery of the reflector dish shown in U.S. Pat. No. 4,755,819 to Bernasconi, et al. in which the antenna reflector comprises an uncured resin in the undeployed state and a toroidal member, both of which are that configured to be inflated to deploy the reflector. When the resin encounters heat from the sun, the reflector hardens and maintains its shape. U.S. Pat. No. 6,272,449 to Bokulic, et al., also discloses a flexible antenna incorporating an inflating toroid. Still other antennas incorporate some other rigid structures to maintain the reflector's shape. For example, U.S. Pat. No. 6,642,796 to Talley, et al. discloses an antenna that includes a rigid center with bendable sections extending from the edge of the rigid center.

These rigidizing members of these latter "light-weight" antennas still add weight to the antenna system and require accommodations for space of any non-flexible, or non-folding structures. Even the inflatable versions require systems and plumbing to inflate the structures, adding more weight and complexity to the system.

Accordingly, a foldable antenna that does not require such rigid components is needed.

BRIEF DESCRIPTION OF THE DRAWINGS

The apparatus is described with reference to the accompanying drawings. In the drawings, like reference numbers indicate identical or functionally similar elements.

FIG. 5 depicts one means of attaching a tension member to a foldable reflector member;

FIG. 6 is a section view of the zipper depicted in FIG. 5;

FIGS. 7A and 7B show an antenna folded;

DETAILED DESCRIPTION

Figure 1:
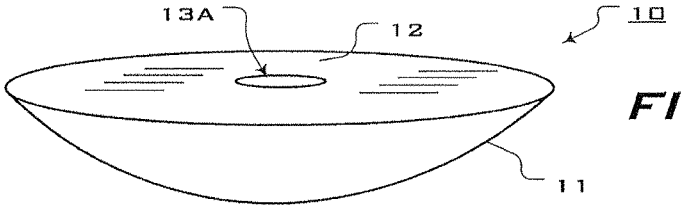
FIG. 1 illustrates an exemplary embodiment of a foldable radio wave antenna.
Figure 2:
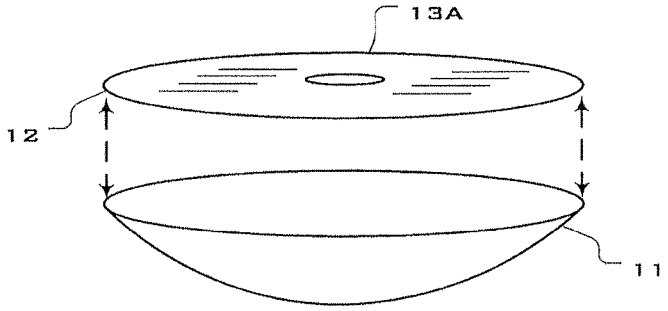
FIG. 2 is an exploded view of the components of the foldable antenna of FIG. 1.
Figure 3:
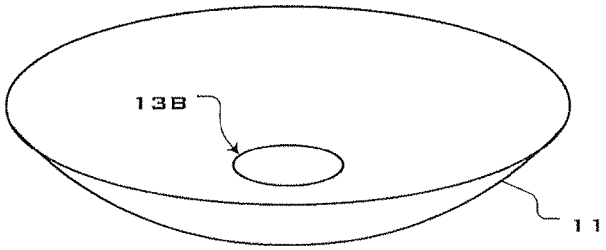
FIG. 3 shows the concave side of an exemplary foldable reflector.

The various embodiments of the disclosed deployment apparatus and their advantages are best understood by referring to FIGS. 1 through 11B of the drawings. The elements of the drawings are not necessarily to scale, emphasis instead being placed upon clearly illustrating the novel features and principles of operation. Throughout the drawings, like numerals are used for like and corresponding parts of the various drawings.

Furthermore, reference in the specification to "an embodiment," "one embodiment," "various embodiments," or any variant thereof means that a particular feature or aspect described in conjunction with the particular embodiment is included in at least one embodiment. Thus, the appearance of the phrases "in one embodiment," "in another embodiment," or variations thereof in various places throughout the specification are not necessarily all referring to its respective embodiment.

A foldable antenna 10 comprises a flexible reflector member 11 and a flexible tension member 12. In its unfolded state, reflector member 11 is a generally parabolic dish having an opening 13*b* defined through its wall and centered at the vertex of the parabola. In its unfolded state, tension member 12 comprises a planar, circular member and also includes an opening 13*a* defined through it at its center.

A suitable antenna 10 is flexible enough to be folded with a low bending radius and with the ability to stay folded under the restraint of a canister, casing, or straps. The reflector member 11 must exhibit a low flexural modulus, and a high tensile modulus in plane, possessing "shape memory", i.e., a tendency of the reflector member 11 to return to its parabolic shape, but with a very low tendency to set when elastically deformed, i.e., creasing along the fold. Thus, the reflector member 11 may be folded and unfolded repeatedly without deterioration of signal quality. The material comprising the reflector member 11 is a composite having a high-elastic-modulus formed of woven fibers, e.g., fiberglass, carbon fiber or aramid, combined with a flexible, but resilient, elastomer binder matrix, for example, silicone resin, polyurethane, or synthetic rubber.

The fiber composite layer could also be a composite of any cloth with any flexible resin as would be appreciated by those skilled in the relevant arts.

The parabolic shape preferably has a relatively high depth-to-diameter ratio, i.e., focal point/diameter (f/d), of between about 0.25 to about 0.30, and confers an automatic increase in short-range and long-range moment of inertia as it unfolds.

Of course, since it is intended to function as an electromagnetic reflector, the reflector member 11 also comprises an electromagnetically reflective fabric, for example, metal-nylon mesh. In one embodiment, reflector member 11 comprises a laminate of an electromagnetically reflective fabric encased in multiple layers of a fiber composite, an elastomer layer, and an aramid. In order to ensure a uniform flexion in all directions, the fibers of each fiber composite layer may be oriented at an offset with respect to adjacent or nearby fiber composite layers. For example, the fibers of a first fiber composite layer may be oriented in a first orientation. The next fiber composite layer may be oriented such that its fibers are angularly offset by about 45° relative the orientation of the fibers of the first layer. The succeeding fiber composite layer may be oriented such that its fibers are angularly offset by about 45° relative the fibers of the preceding layer, and so on.

Thickness of the resulting laminate should be sufficient to be resilient and retain shape memory of the parabolic considering the diameter of the reflector, but thin enough to be folded to a low bend radius. For example, if the laminate is not thick enough, it will not hold its shape when it is deployed. If it is too thick, the reflector will not be pliant enough to fold. For a reflector diameter of 0.9 m, a suitable thickness is about 50 mils.

Figure 8:
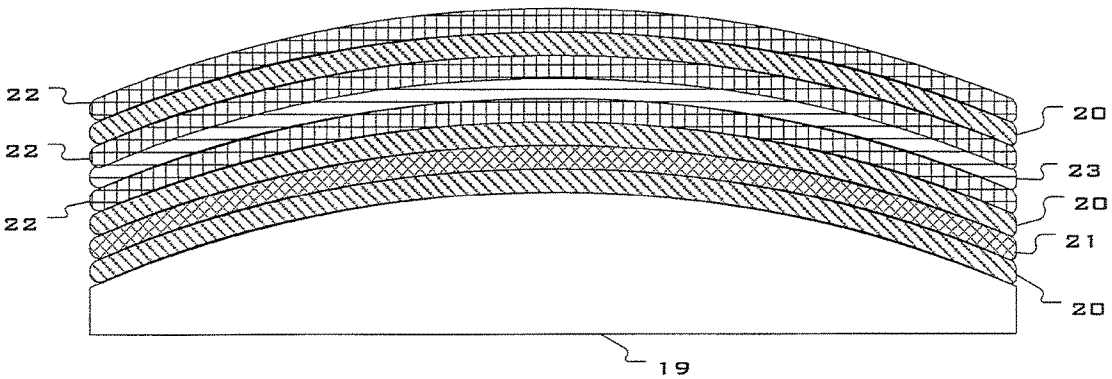
FIG. 8 illustrates an exemplary laminate comprising the reflector member.

With reference to FIG. 8, the reflector member 11 may be formed by laying the multiple layers of material over a mandrel 19 of the desired f/d ratio. The first layer in this example is a fiber composite layer 20 and is overlaid with a metal nylon mesh layer 21. Another fiber composite layer 20 overlays the mesh layer 21 and an elastomer layer 22. An aramid layer 23 is then placed over which is laid another fiber composite layer 20 sandwiched between elastomer layers 22. More layers of fiber composite 20 and elastomer 22 may be added. As will be appreciated by those skilled in the art, the layers, in some embodiments, may be bonded together using heat, a vacuum or combinations of both.

Tension member 12 is also foldable and may also comprise a laminate of layers of fiber composite and an elastomer binder and may be between about 6 to about 8-mils in thickness having a diameter roughly equal to that of the reflector member 11. In one embodiment, tension member 12 is permanently bonded by its circumferential edge to the peripheral rim of the reflector member 11. In another embodiment, shown in FIG. 2, the tension member 12 may be detachable from the reflector member 11. With reference to FIGS. 5 and 6, a circumferential zipper 17 may be used to attach tension member 12 to the reflector member 11. Once attached, the tension member 12 draws the peripheral rim of the reflector member 11 centrally ensuring the edges maintain a circular shape. This reduces warping in the reflector member's 11 dish shape which would otherwise degrade antenna performance.

Zipper 17 may be installed by attaching a rim 18 that may comprise the same laminate as that of the tension member 12 to the peripheral rim of the reflector member 11 and attaching one side of the zipper to the radially inward edge of the rim 18. It will be appreciated that preferably zipper 17 comprises an electromagnetically transparent material to avoid interference with the radio wave signals. In addition, other means of attaching the tension member 12 to the reflector member 11, such as a ring of elastomeric material, which may serve to some extent the functions of the zipper, may be employed as will be appreciated by those skilled in the art.

Figure 4:
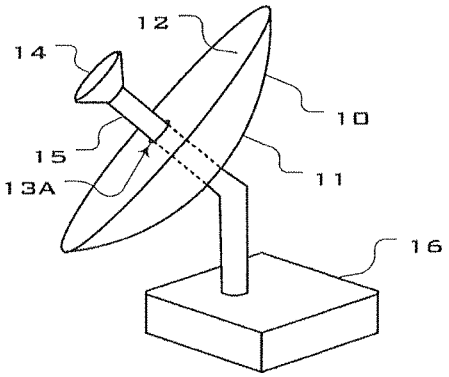
FIG. 4 illustrates an exemplary foldable antenna installed on an exemplary antenna positioning apparatus.

FIG. 4 illustrates the antenna deployed with an antenna control system 16. A mast 15 extends from the control system 16. The antenna 10 is mounted to the mast 15 by inserted the mast 15 through the openings 13*a, b* in the reflector member 11 and the tension member 12. A feed horn 14 is located on the end of the mast 15.

When the antenna 10 is to be stowed, it is removed from the mast 15 and the tension member 12 is detached from the reflector member 11. Both the tension member 12 and the reflector member 11 may then be refolded, as illustrated in FIGS. 7A and 7B.

Figure 9C:
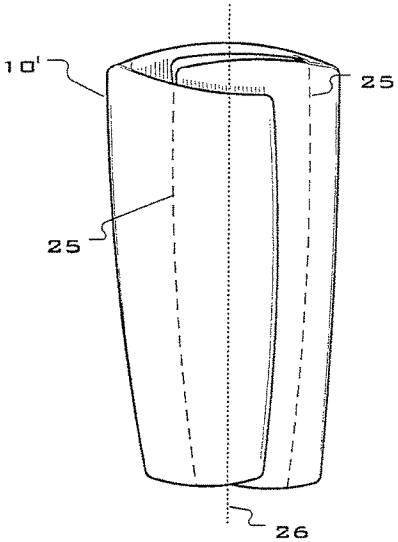
FIGS. 9A-9C present an alternative embodiment of a foldable antenna.
Figure 9B:
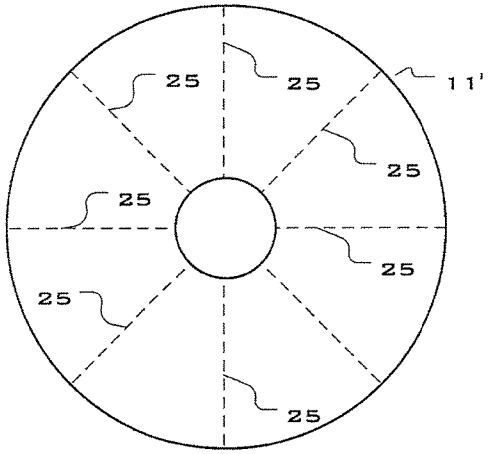
Figure 9A:
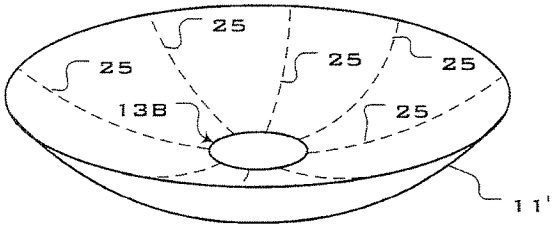

An alternative embodiment of a foldable antenna is depicted in FIGS. 9A and 9B in which a flexible reflector member 11' comprises a plurality of radial ribs 25 that are embedded in the laminate forming the reflector member 11', preferably in between layers 20, 22 on the opposite side of the mesh layer 21 from the focus point of the parabola defining the reflector member 11'. Ribs 25 comprise a curve corresponding to the curve of the parabola and may be formed from any resilient material that retains a curved shape, for example 32 gauge wire. Owing to the resilience of the ribs 25, i.e., shape memory, they bias the reflector member 11' toward an open, parabolic shape. Accordingly, when the reflector member 11' is not constrained, it will automatically deploy. Of course, those skilled in the relevant arts will appreciate that if ribs 25 comprise a metal substance, care must be taken to locate ribs 25 to avoid unwanted interference with a radio wave signal. For the same reason, ribs 25 may preferably comprise a resilient material with low conductivity such as fiberglass/phenolic composite. Note that FIG. 9A shows the reflector member 11' in an "open state." FIG. 9C shows a foldable antenna 10' having ribs 25 folded for stowage. In this embodiment, ribs 25 may limit the manner in which the antenna 10' may be folded. The antenna 10' may be folded in a rolled arrangement forming a frustoconical arrangement, keeping the ribs 25 roughly aligned with the long axis of the frustum 26. Note that FIG. 9C shows the reflector member 11' in a "closed state."

It should be noted the reflector member 11' in FIGS. 9A and 9B is shown without the tension member 12, described above, for clarity of illustrating the present embodiment. It should be understood that a foldable antenna 10' embodying the reflector member 11' may advantageously comprise a tension member 12 as well.

Figure 10:
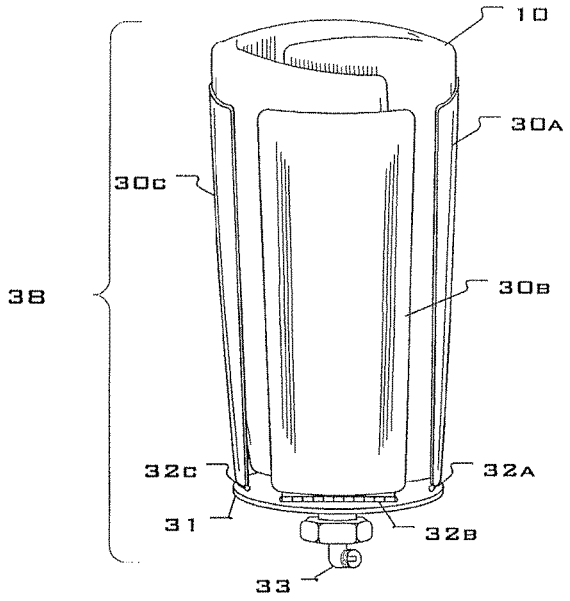
FIG. 10 is an antenna folded and stowed in an exemplary retaining assembly.

In FIG. 10, an exemplary retaining assembly 38 using a foldable antenna 10 is shown having a mounting plate 31, to one surface of which is pivotally attached a plurality of retaining leaves 30*a*-30*c*. This view depicts the foldable antenna 10 in a folded, stowed condition being maintained in such arrangement by the position of the retaining leaves 30*a*-30*c*, roughly perpendicular to the mounting plate 31. However, leaves 30*a*-30*c* are preferably pivotally attached to mounting plate 31 such that they are biased to rotate outward from the antenna 10. Mounting plate 31 is configured with an opening (not shown) through which signal feed may be conveyed to the feed horn. A signal feed connector 33 extends from the opposing surface of the mounting plate 31. In one embodiment, the reflector member is bolted to the feed mast 15, which is bolted to the mounting plate 31.

Figure 11:
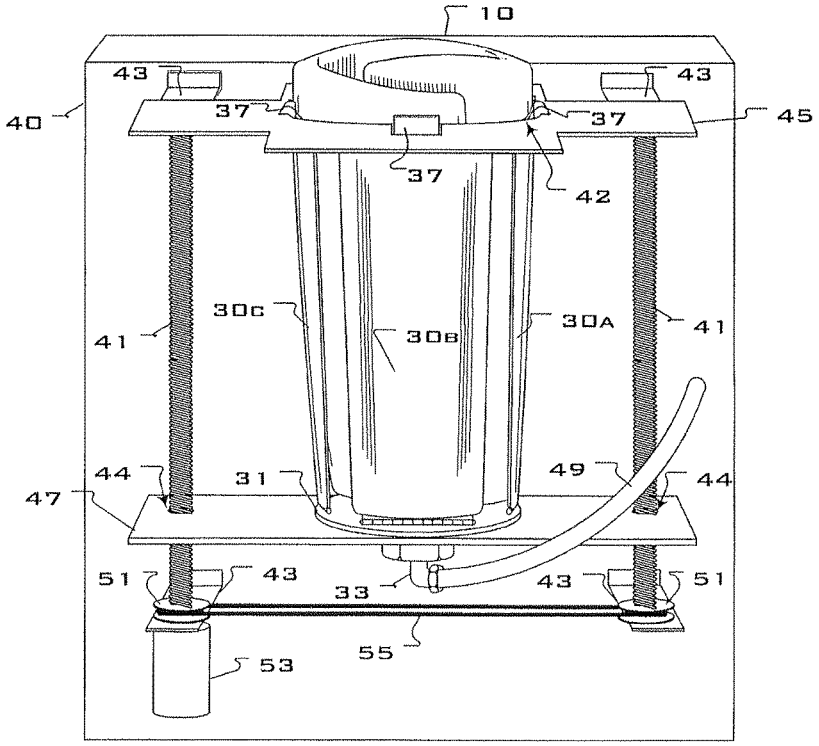
FIG. 11 depicts the retaining assembly containing a folded antenna installed in an antenna deployment apparatus and in a stowed position.

FIG. 11 shows the retaining assembly 38 of FIG. 9 installed on a satellite 40 in an assembly for deploying the antenna 10. Mounting plate 31 is seated on one surface of a collar member 47 configured with threaded female openings 44 in which a corresponding number of parallel drive screws 41 are threadably engaged. The drive screws 41 are oriented roughly perpendicularly to the collar member 47 and each screw 41 includes a pulley 51*a, b* mounted to one end that are coupled to one another by a drive belt 55 such that rotation of one pulley 51*a* is imparted to the other pulley 51*b*, and thus, to both drive screws 41. Pulleys 51*a, b* are both supported by mounting flanges 43 which extend from the satellite body 40. A motor 53, which also may be supported by a mounting flange 43, is coupled to one of the pulleys 51*a* and is configured to drive rotation of the pulley 51*b* either clockwise or counter-clockwise. Drive screws 41 are arranged in parallel such that the threads of both are in a corresponding orientation.

Bearing plate 45 attached to and supported by mounting flanges 43 extending from the satellite body 40 provides a journal bearing against which the ends of the drive screws 41 opposite the pulleys 51*a, b* are engaged such that the screw 41 ends are allow to freely rotate. Bearing plate 45 also comprises a central opening 42 defined and dimensioned to accommodate the retaining assembly 38 in its stowed configuration. The inner edge of the opening 42 preferably includes a plurality of roller bearings 37 to reduce friction resulting from sliding contact between the leaves 30 and the inner edge of the opening 42. A signal feed line 49 extends from the satellite body 40 and is coupled to the feed connector 33.

Figure 11A:
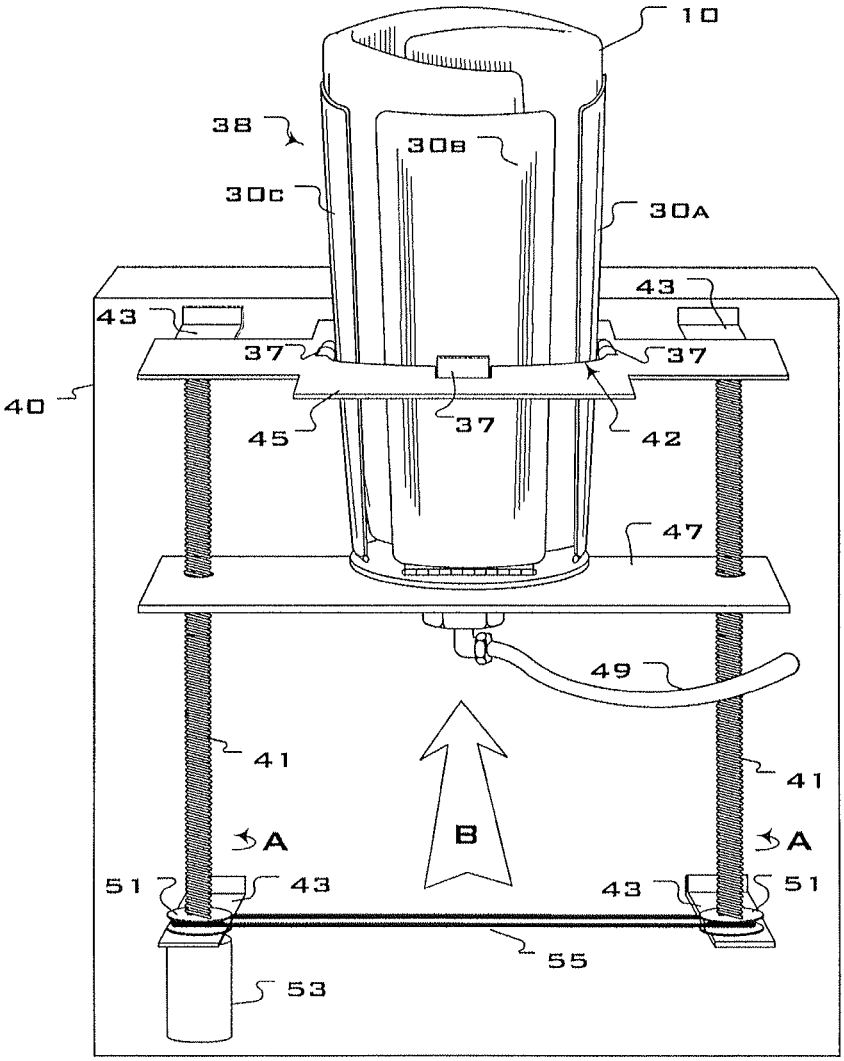
FIG. 11A shows the retaining assembly containing a folded antenna being moved toward a deployed position.
Figure 11B:
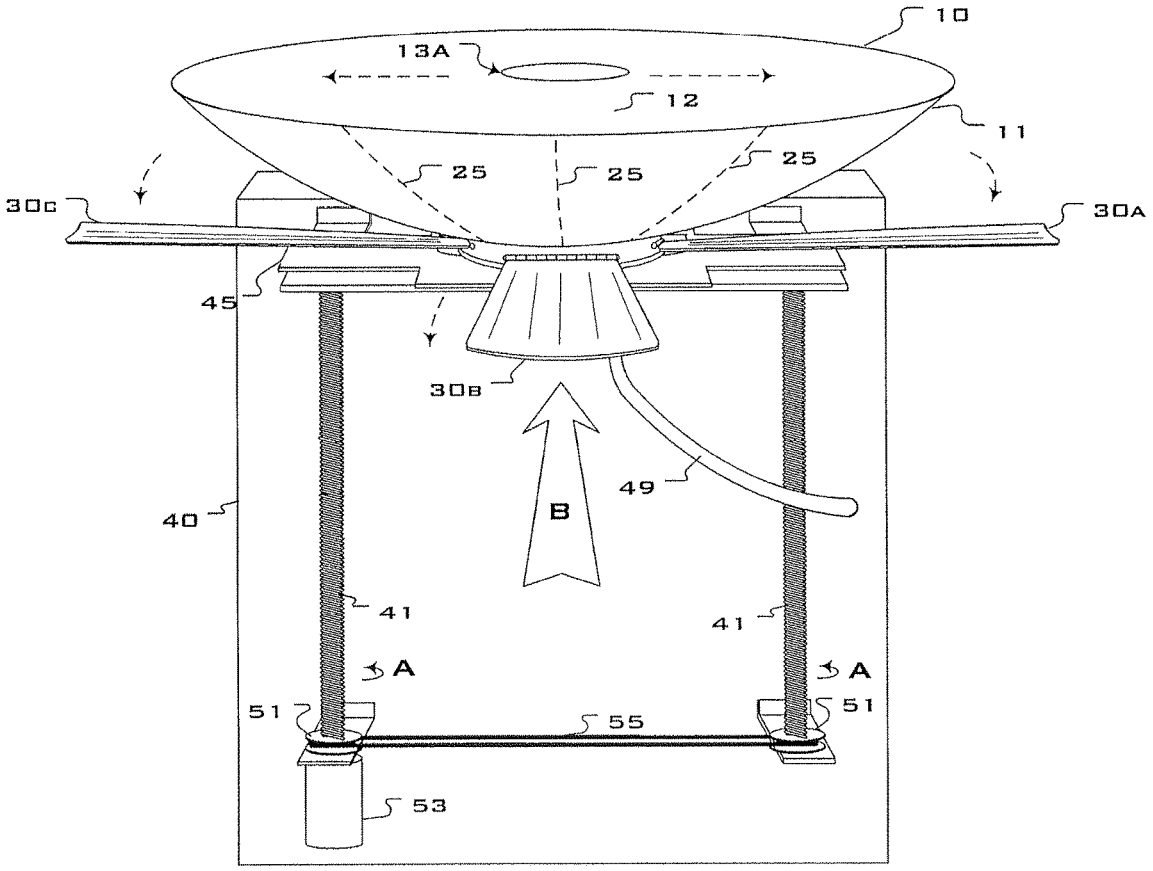
FIG. 11B shows a foldable antenna in a deployed position.

FIGS. 11A and 11B illustrate deployment of the antenna 10 where, upon command from the satellite control system (not shown), motor 53 drives rotation of pulley 51*a* in one direction which rotational movement is transmitted to the opposite pulley 51*b*, thereby causing drive screws 41 to rotate accordingly. Since the collar member 47 is threadably engaged with both screws 41, rotation of the screws 41 induces linear movement in the collar member 47. Further, rotation of the screws 41 in one direction (reference arrow "A") actuates the collar member 47 linearly toward the bearing plate 45 (reference arrow "B") and rotation in the opposite direction actuates the collar member 47 away from the bearing plate 45. Therefore, as shown in FIG. 11A, as the collar member 47 moves toward bearing plate 45, retaining assembly 38 transits through opening 42 in collar member 45.

Once the collar member 47 completes its transit along drive screws 41, the retaining assembly 38 is free of the opening 42 in the bearing plate 45 and retaining leaves 30*a-c* are allowed to rotate outward (FIG. 11B). In turn, this allows antenna 10 to deploy to its parabolic shape for transmission and reception of radio frequency signals, urged to open by the resilient ribs 25 embedded within the laminate comprising the reflector member 11'. The ribs are behind the reflective surface and therefore do not interfere with the signal. In typical satellite applications, the antenna does not need to be retracted.

As described above and shown in the associated drawings, the present invention comprises a foldable radio wave antenna deployment apparatus for a satellite. While particular embodiments have been described, it will be understood, however, that any invention appertaining to the antenna described is not limited thereto, since modifications may be made by those skilled in the art, particularly in light of the foregoing teachings. It is, therefore, contemplated by the appended claims to cover any such modifications that incorporate those features or those improvements that embody the spirit and scope of the invention.

What is claimed is:

1. An antenna, comprising:

a parabola-shaped, flexible reflector member having a peripheral rim;

one or more radial ribs embedded in the flexible reflector member and arranged to bias the reflector member in an open state; and a generally circular tension member defining a central opening, the generally circular tension member having a having a circumferential edge that is coupleable with the peripheral rim of the flexible reflector member such that generally circular tension member spans an interior space defined by the peripheral rim, the generally circular tension member being configured to draw the peripheral rim of the flexible reflector member centrally such that an edge of the peripheral rim maintains a generally circular shape.

2. The antenna of claim 1, wherein the radial ribs are embedded in laminate forming the flexible reflector member.

3. The antenna of claim 1, wherein the radial ribs are embedded between a fiber composite layer and a elastomer layer of the reflector.

4. The antenna of claim 1, wherein the one or more radial ribs are composed of wire.

5. The antenna of claim 4, wherein the wire is 32-gauge.

6. The antenna of claim 1, wherein the one or more ribs are composed of a material with low conductivity.

7. The antenna of claim 6, wherein the material is fiberglass/phenolic composite.

8. An antenna system, comprising:

a parabola-shaped, flexible reflector member;

one or more radial ribs embedded in the flexible reflector member and arranged to be foldable to a closed state; and a retaining assembly comprising:

a mounting plate;

a plurality of retaining leaves positioned around an exterior of the flexible reflector member, wherein a proximal end of each of the plurality of retaining leaves is pivotally coupled with the mounting plate and a distal end of each of the retaining leaves is unconstrained; and a collar member that is coupled with the mounting plate such that a distance between the mounting plate and the collar member is adjustable, the collar member defining an opening having an edge that is configured to contact an outer surface of each of the plurality of retaining leaves, wherein:

the retaining assembly is configured to move between:

an deployed configuration in which the mounting plate and the collar member are positioned proximate to one another to lower a contact position of the collar member with the outer surfaces of the plurality of retaining leaves such that the plurality of retaining leaves pivot toward the mounting plate, thereby allowing the flexible reflector member to expand to an opened state; and a retained configuration in which the mounting plate and the collar member are positioned apart from one another to raise a contact position of the collar member with the outer surfaces of the plurality of retaining leaves such that the plurality of retaining leaves pivot toward the flexible reflector member, thereby causing the flexible reflector member to fold.

9. The antenna system of claim 1, further comprising a retaining assembly adapted for retaining the flexible reflector member in the closed state.

10. The antenna system of claim 9, wherein the retaining assembly comprises a plurality of retaining leaves pivotally mounted perpendicular to a mounting plate.

11. The antenna system of claim 10, wherein the retaining leaves are biased to rotate outward from the flexible reflector member.

12. The antenna system of claim 10, wherein the mounting plate comprises an opening through which signal feed may be conveyed to a feed horn.

13. The antenna system of claim 12, wherein the mounting plate is moveably coupled to a satellite.

14. The antenna system of claim 13, wherein upon receiving a signal from a satellite control system of the satellite, the reflector member deploys from its closed state.

15. The antenna system of claim 8, further comprising a motor coupled with the retaining system, wherein the motor controls the relative positions of the mounting plate and the collar member.

16. The antenna system of claim 15, wherein the retaining system is coupled with a satellite, and wherein the motor is configured to move the retaining system from the retained configuration to the deployed configuration upon receiving a signal from a satellite control system of the satellite.

* * * * *